United States Patent [19]

Leroy et al.

[11] 3,992,194

[45] Nov. 16, 1976

[54] METHOD AND APPARATUS FOR USE IN THE TREATMENT OF METALS IN THE LIQUID STATE

[75] Inventors: Pierre Leroy, Saint-German-en-Laye; Jean Bastien, L'Etrat, both of France

[73] Assignee: Creusot Loire, Paris, France

[22] Filed: Mar. 13, 1975

[21] Appl. No.: 558,111

[30] Foreign Application Priority Data

Apr. 11, 1974 France ..... 74.12784

[52] U.S. Cl. ..... 75/52; 75/59; 75/60

[51] Int. Cl.[2] ..... C21C 5/34

[58] Field of Search ..... 75/52, 59, 60

[56] References Cited

UNITED STATES PATENTS

| | | | |
|---|---|---|---|
| 3,706,549 | 12/1972 | Knuppel | 75/60 |
| 3,751,242 | 8/1973 | Knuppel | 75/52 |
| 3,891,429 | 6/1975 | Cox | 75/60 |

*Primary Examiner*—Peter D. Rosenberg
*Attorney, Agent, or Firm*—Haseltine, Lake & Waters

[57] ABSTRACT

In a method of treatment of liquid metal by blowing in at least one fluid in the form of jets emitted by blast pipes, the jets being arranged in at least two groups of which one group is supplied with fluid at high pressure to provide high impetus jets for a part of the treatment and the other group is supplied with fluid at lower pressure to provide lower impetus jets, the fluid supplies having variable pressures such that the jets can all be supplied with lower pressure fluid for another part of the treatment.

9 Claims, 2 Drawing Figures

METHOD AND APPARATUS FOR USE IN THE TREATMENT OF METALS IN THE LIQUID STATE

Figure 1:
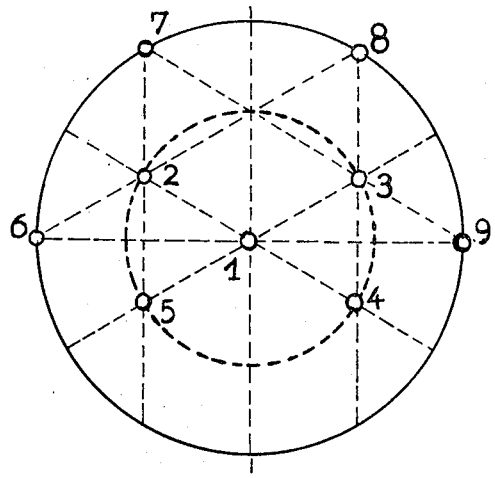

The present invention relates to a method for the treatment of metals in the liquid state such as, for example, the oxidizing conversion of liquid cast iron into steel.

Numerous different types of blast pipes are known which are capable of insufflating or injecting one or a number of fluids into a liquid metal mass in order to modify its composition by oxidizing reactions, by reducing reactions, or by stirring. These blast pipes extend through the thickness of the wall or bottom of the metallurgical container, that is to say, they pass through both the metal wall of the container and its refractory lining. Blast pipes of this kind can blow in either vertically or obliquely upwards (for example, if they are arranged in the bottom or near the bottom of the side wall of the metallurgical container), or horizontally, or downwardly and in this latter case usually obliquely.

Generally blast pipes of this kind have their mouths below the surface of the metal bath but they may in certain cases, also have their mouths above this surface.

These blast pipes may also be classed as simple blast pipes, double blast pipes or multiple blast pipes. A simple blast pipe with a single pipe can be fed only with a single flow of a single fluid or a mixture of fluids. A double blast pipe with two separate pipes can be fed with two different fluids. A multiple blast pipe with a plurality of separate pipes can be fed with a plurality of different fluids.

Thus, for example, in the conversion of liquid cast iron into steel, blast pipes are sometimes employed which consist of two concentric pipes, the central pipe being fed with oxygen and the peripheral pipe with a fluid for protecting the blast pipe against wear by corrosion under heat in an oxidizing medium.

One general characteristic of all jets emitted by known blast pipes is that for a given circuit fed with a given fluid (or mixture of fluids) there exists at any instant a relationship between the flow and the pressure and that one cannot be modified without the other being affected. This flow-pressure relationship characterizer the permeability or "load losses" of the circuit in question at any moment.

One important consequence of this characteristic is that the flow of a fluid jet introduced through a blast pipe into a metal bath cannot be modified without also modifying its impetus.

It is known that the impetus G of a fluid jet leaving a pipe is in the most general case given by the following:

$$G = \int s\,(\rho v^2 + P)\,dS,$$

being an expression in which:

$\rho$ is the density of the fluid;

$v$ is the velocity of the fluid;

$P$ is the static pressure;

$S$ is the cross-sectional area of the jet.

The impetus is a force and is expressed in newtons. It is the force of reaction of the jet in question against the blast pipe, sometimes still called the thrust. It is also the force of penetration of the fluid jet into the metal bath, considered at emergence from the blast pipe.

It is known how to calculate the impetus by applying the expression $(x)$ as a function of the flow cycle and various magnitudes normally measured, such as pressure, flow, cross-section of passage.

It is easily imagined that a high-impetus fluid jet emerging into a metal bath exhibits characteristics both of hydrodynamic order and of metallurgical order, which are different from those of a jet of lower impetus. Now, in blast pipes of known types it is not possible to modify the impetus of a fluid jet without also modifying its mass flow, just as it is not possible to modify its mass flow without modifying its impetus.

This interdependence of these two magnitudes results from the fact that the flow area at the outlet from the blast pipe is fixed once and for all and is not adjustable at will.

This limitation can in many metallurgical treatments of liquid metals present serious disadvantages.

Thus in the oxidizing conversion of liquid cast iron into steel the mean flow of refining oxygen is often determined by the optimum duration of the operation, this being fixed by the time necessary for complete fusion of scrap added to the bath of liquid cast iron or by any other local consideration.

Now for a given depth of metal bath above the tip of a submerged blast pipe the proportion of oxygen blown through the blast pipe and which emerges from the bath, burning carbon monoxide into carbon dioxide actually inside the converter above the bath and the slag, is essentially a function of the impetus of the jet. Now, it is advantageous to be able to adjust the proportion of carbon monoxide burnt into carbon dioxide independently of the adjustment of the flow of oxygen. Again, the conditions of formation of the slag and hence the dephosphorization may be a function of the impetus of the jets of the oxygen being blown in.

An object of the present invention is to enable the adjustment independently of one another of the impetus and the mass flow of the main fluid for refinement of a metal bath in order to act at will upon the phenomena of hydrodynamic order (e.g. stirring, movements of the bath) and upon the phenomena of metallurgical order.

According to one aspect of the present invention, there is provided a method of treatment of a metal in the liquid state by blowing in at least one fluid in the form of jets emitted from blast pipes passing through the wall or bottom of the liquid metal container, wherein the jets are arranged in at least two groups, the groups being supplied with the fluid at pressures which are adjustable independently of one another, such that one of the groups of jets is fed at a lower fluid pressure to provide relatively low-impetus jets and another of the groups of jets is fed at a fluid pressure which is substantially higher to provide high-impetus jets.

The apparatus for carrying out the method described above, comprises blast pipes passing through the wall or bottom of the metallurgical container for the metal, wherein the blast pipes are arranged in at least two groups, each group having its own fluid feed means, so that each of the groups of blast pipes can be fed at a fluid pressure different from that which feeds the other groups or groups.

Preferably, the total area of the jets or blast pipes of the group intended to provide high impetus jets during certain special blast periods and the total area of the jets or blast pipes of the group intended to provide low impetus jets during these same periods are calculated so that, taking into account the maximum upstream pressure which is available, the flow of fluid introduced at high impetus for a given overall flow from all the jets is adjusted to the metallurgical or hydrodynamic results that it is required to obtain during these special blast periods and that outside these high impetus periods the overall flow of fluid in the whole of the blast pipes being fed then at the same pressure and at low or reduced impetus remains suitable, taking into account, for example, the blast time being aimed at.

In an embodiment particularly applicable to the refinement of steel in a converter blowing in pure oxygen through the bottom, it is advantageous for the total area of flow of the oxygen in the group of high impetus jets to be between 10% and 40% of the total area of flow of all the oxygen jets, while the maximum blast pressure of the oxygen measured upstream of the high impetus blast pipes lies between 16 and 25 bars.

The invention is especially applicable to pure oxygen blast pipes protected against wear by a peripheral injection of hydrocarbons.

In the case where the blast pipes are located in the bottom of a converter, the blast pipes capable of blowing in at high impetus are advantageously arranged towards the center of the bottom so that their wearing effect upon the refractoy lining on the sides is not perceptible.

If powdered lime in suspension in a flow of pure oxygen is employed, the powdered lime is preferably insufflated into the oxygen feeding the lower-impetus jets and not into the oxygen feeding the high-impetus jets because the kinetic energy of the particles of lime which are solid and therefore dense often has too great a tendency to drive these particles out of the bath after passing through it.

One of the main advantages of use of the method of the invention is that for one and the same overall mass flow of the fluid in question the impetus of the jets can be made to vary, and consequently their degree of penetration into the metal bath to be treated, by acting on the fluid feed pressures of each group of jets. The fluid flow areas in each group should be calculated so that:

in a uniform blast period, for a mean blast pressure feeding the whole of the jets, the total flow of fluid is suitable for the duration in view for the metallurgical operation, in an "unbalanced" blast period, that is to say, with high impetus jets from one group of blast pipes and lower impetus jets from the other group or groups, the flow at high impetus constitutes a fraction suitable for the metallurgical and hydrodynamic effects to be obtained.

In basic terms, the low impetus jets are "soft" jets acting particularly at depth whilst the high impetus jets are "hard" jets acting more at the surface of the metal bath.

By use of the invention an effect can be obtained similar to that which it is already known and obtained by means of lances blasting on top of the metal bath the height of the lance being made to vary, or by varying the aerodynamic characteristics of the main oxygen jet before it leaves the lance or just at this point by a variable throttling. It is known that by one or other of these two means (variable height of the lance, or a lance with throttling) it is possible to improve the speed of dephosphorization of the metal bath with respect to its speed of decarburization, or vice versa.

By use of the invention, in spite of the absence of mobility of the blast pipes and in spite of fixed areas of flow, by acting on the different feed pressures of the two groups or the several groups of blast pipes, taking into account the depth of metal bath located above the output sections of the jets, one can obtain for one and the same overall oxygen flow or with substantially the same flows, different hydrodynamic, chemical and metallurgical effects according to whether certain jets do or do not have high impetus with respect to the others.

High impetus jets can enable the following exemplary factors to be acted upon:

a. The relative speeds of dephosphorization and decarburization.
b. The formation of a liquid slag.
c. The combustion of the carbon monoxide into carbon dioxide above the surface of the bath.
d. The degree of stirring of the bath by the jets and by the products arising from the reactions, such as the carbon monoxide, for example.

Figure 2:
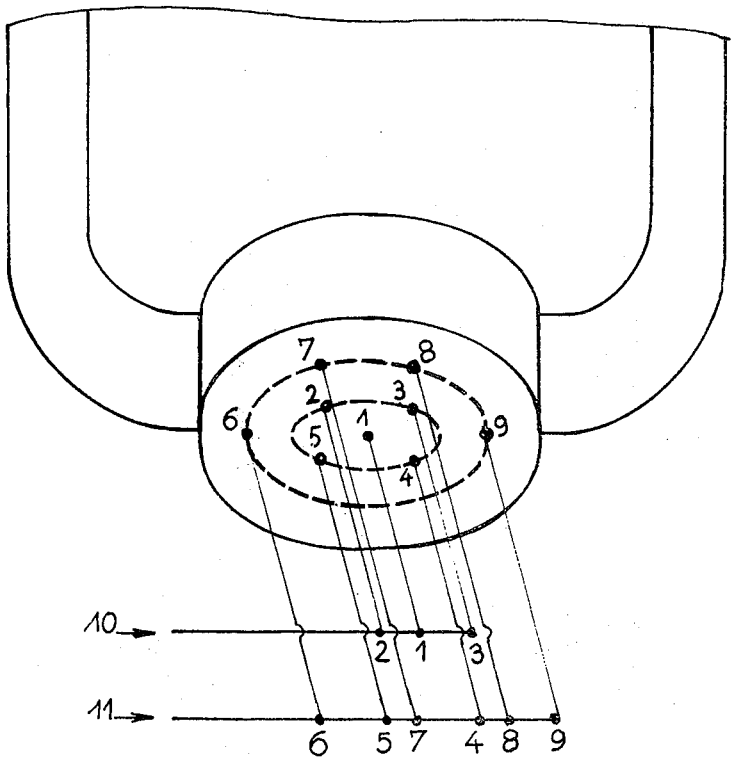

The invention will be more fully understood from the following description of an embodiment thereof, given by way of example only, with reference to the accompanying drawings, in which:

FIG. 1 diagrammatically illustrates the distribution of nine blast pipes in the bottom of a converter, and FIG. 2 is a diagram of the system of feeding oxygen to these nine blast pipes.

The embodiment described below is used in the conversion of cast iron into steel. This is effected in a steelworks converter pouring 50 tons of liquid steel manufactured from a Thomas melt having 1.8% phosphorus and 3.7% carbon by blowing in pure oxygen by means of nine double blast pipes 1 to 9 each protected by fuel oil at their periphery.

The central pipe of each blast pipe, having an inside diameter of 20 mm and an outside diameter of 25 mm, exhibits a flow area for the pure oxygen of 314 $mm^2$. Each blast pipe can feed:

46 $Nm^3$/min at the maximum pressure of 20 bars measured upstream of the blast pipe, 5 $Nm^3$/min at the minimum pressure of 2 bars, below which there would be a risk of the central pipe being plugged by liquid metal during blowing in.

An outer pipe concentric with the central pipe has its wall inner surface very close to the outer surface of the central pipe. Between these two pipes flows the fluid for protecting the tip of the blast pipe against wear under heat, which protective fluid is fuel-oil in the present embodiment.

The blast pipes 1 to 9 are distributed in two groups. The first group consists of the blast pipes 1, 2 and 3, which are the more central and are fed with oxygen by a collector 10. The second group consists of the blast pipes 4 to 9 which are fed with oxygen by a collector 11.

In this embodiment the flow area of oxygen in the three blast pipes of the first group represents 33% of the total area of the nine blast pipes and the maximum oxygen pressure available upstream of the blast pipes is 20 bars.

The first group is that which blows in oxygen at high impetus during certain special blast phases.

In practice the first group is supplied with oxygen at pressures which vary over the whole range of pressures from 2 to 20 bars, while the second group in fact only uses pressures from 2 to 12 bars.

This second group of blast pipes 4 to 9 is fed with oxygen which may hold powdered lime in suspension.

The nine blast pipes are employed in two successive conditions of oxygen flow for two successive phases of the conversion.

a. A normal condition balanced across all the blast pipes, at reduced overall impetus. The nine blast pipes are fed with oxygen at a pressure of 12 bars. Each of the pipes passes 27 $Nm^3$/min of oxygen or 243 $Nm^3$/min altogether. This first period lasts 8 minutes during which 1944 $Nm^3$ of oxygen are blown in. The carbon content of the bath which was initially 3.7% in the melt at charging has become 0.850% while the phosphorus content has gone from 1.8% to 1%.

b. A high-impetus condition. Without powdered lime in suspension in the oxygen this condition is obtained as follows. The three blast pipes 1, 2 and 3 are fed at 20 bars and each pass at high impetus 46 $Nm^3$/min of oxygen, or 138 $Nm^3$/min in total for the three blast pipes.

The other six blast pipes 4 to 9 are fed with oxygen at 8 bars, and each pass 18 $Nm^3$/min or 108 $Nm^3$/min in total for the six blast pipes.

The total flow of the nine blast pipes is thus 246 $Nm^3$/min or substantially the same as in the previous phase (243 $Nm^3$/min) but the overall impetus, because of the three blast pipes 1, 2 and 3, is higher, about 6000 Newtons against 4500 Newtons in the previous phase, and the individual impetus of each of the central blast pipes 1, 2 and 3 is much higher (1500 Newtons each) than that of each of the nine blast pipes in the previous condition (500 Newtons each). The result is that the oxygen jets emitted by the three blast pipes 1, 2 and 3 are more penetrating and react at the surface of the metal bath and even above this surface.

Alternatively, in the present condition the oxygen blown in through the six low impetus blast pipes may contain powdered lime in suspension and the actual blast pressure, a little higher than 8 bars, is then adjusted so as to ensure flow in each of these six blast pipes of:

a. the oxygen flow of 18 $Nm^3$/min per blast pipe;

b. a flow of powdered lime of 72 kg per minute per blast pipe.

Under these conditions the second phase of the conversion enables, while lowering the carbon content of the bath from 0.850% to 0.027%, parallel lowering of its phosphorus content from 1% down to 0.100% phosphorus. After that an extremely short dephosphorization without decarburization (some tens of seconds) is sufficient to obtain the required final phosphorus content: 0.025% in this example.

The duration of this second blast phase at high impetus is 4 minutes and the total blast duration of the two phases is therefore 12 minutes (without interruption of the blast between the two phases).

In the present example the two main advantages resulting from the high impetus blast phase are:

a. A dephosphorization which is produced almost entirely by decarburization and which for this reason is improved by good stirring of the slag and of the metal by the carbon monoxide coming from the bath.

b. A partial combustion above the bath of CO into $CO_2$ by a portion of the oxygen blown in by the three high impetus blast pipes and which succeeds in coming to the surface. This secondary combustion increases the thermal balance of the conversion operation.

Of course the preceding example is not restrictive. It is possible in certain cases to finish the dephosphorization in the same time as the decarburization, or even to a carbon content of the bath higher than that of extra-mild. In this latter case it may be useful to finish off the blasting by feeding all the blast pipes for some tens of seconds at maximum possible pressure. In this way stirring between slag and metal gets further increased and if the carbon content of the bath is still sufficient at this moment a reduction of the iron oxide in the slag by the carbon in the bath may be produced, causing drying of the slag which for this reason will no longer be reactive and rephosphorization by return to the balance between slag and metal is thus avoided. This latter operational method is particularly applicable in the case of treatment of haematite melts.

What is claimed is:

1. In the treatment of a metal in the liquid state by blowing into the bath under the bath level at least one fluid in the form of jets emitted from submerged blast pipes, the improvement comprising arranging the jets in at least two groups, supplying the groups with refining fluid at independently adjustable positive pressures such that one of the groups of jets is fed at a lower fluid pressure to provide relatively low impetus jets and another of the groups of jets is fed at a fluid pressure which is substantially higher to provide high impetus jets.

2. A method as claimed in claim 1, for use in the refinement of steel by pure oxygen as the refining fluid, wherein the maximum oxygen pressure upstream of said other group of jets of high impetus lies between 16 and 25 bars.

3. A method as claimed in claim 2, wherein said other group of jets is supplied with pure oxygen and the one group of jets is supplied with oxygen which contains powdered lime in suspension.

4. A method as claimed in claim 2, wherein said other group of jets has high impetus during only one portion of the refining operation.

5. A method as claimed in claim 1, wherein the groups of jets are fed from separate collectors of said refining fluid, said collectors being respectively at said higher and lower pressures.

6. A method as claimed in claim 5, wherein each pipe has a central conduit and an outer conduit, the refining fluid being passed through the central conduits of said blast pipes at the respective pressures, a protective fluid being passed in the outer conduits around the periphery of the central conduits of said pipes.

7. A method as claimed in claim 1, wherein the pressures in groups of jets are unbalanced as regards the higher and lower pressures to provide substantially the same total flow rate as compared to equal pressures as all jets but with substantially higher impetus.

8. A method as claimed in claim 1, wherein said jets are arranged in circumferential rows, the jets at higher pressure being in the interior of the arrangement while the jets at lower pressure are at the exterior of the arrangement.

9. A method as claimed in claim 2, wherein the flow of refining fluid in the high impetus jets represents 10 – 40% of the total flow of all the fluid in all the jets

* * * * *